US011628544B2

(12) United States Patent
Chen

(10) Patent No.: US 11,628,544 B2
(45) Date of Patent: Apr. 18, 2023

(54) HOOK SPANNER

(71) Applicant: SHIN-YAIN INDUSTRIAL CO., LTD., Taichung (TW)

(72) Inventor: Pen Hung Chen, Taichung (TW)

(73) Assignee: SHIN-YAIN INDUSTRIAL CO., LTD., Taichung (TW)

( * ) Notice: Subject to any disclaimer, the term of this patent is extended or adjusted under 35 U.S.C. 154(b) by 163 days.

(21) Appl. No.: 17/374,934

(22) Filed: Jul. 13, 2021

(65) Prior Publication Data

US 2023/0020513 A1 Jan. 19, 2023

(51) Int. Cl.
*B25B 13/50* (2006.01)

(52) U.S. Cl.
CPC ..... *B25B 13/50* (2013.01)

(58) Field of Classification Search
CPC ..... B25B 13/48; B25B 13/50; B25B 27/14
See application file for complete search history.

(56) References Cited

U.S. PATENT DOCUMENTS

| | | | | |
|---|---|---|---|---|
| 10,882,163 | B2 * | 1/2021 | Sweeney | B25B 13/50 |
| D912,482 | S * | 3/2021 | Miller | B25B 23/0028 D8/21 |
| D913,762 | S * | 3/2021 | Sweeney | B25B 13/50 D8/27 |
| 11,117,245 | B2 * | 9/2021 | Rodeheaver | B25B 13/5091 |
| 11,279,006 | B2 * | 3/2022 | David | B25B 13/48 |
| 2019/0126444 | A1 * | 5/2019 | Rodeheaver | B25B 13/50 |

* cited by examiner

*Primary Examiner* — David B. Thomas
(74) *Attorney, Agent, or Firm* — Hershkovitz & Associates, PLLC; Abe Hershkovitz

(57) ABSTRACT

A hook spanner has a spanner body having two opposite side surfaces, a handle segment, and a hooking segment formed on an end of the handle segment. The hooking segment has an abutting end surface located away from the handle segment and having an abutting end surface extending obliquely from one of the two opposite side surfaces of the spanner body to the other side surface. The hook spanner is adapted to turn a nut having multiple grooves arranged around the nut. Each groove has an inclined surface extending obliquely and inwardly from a peripheral surface of the nut. The abutting end surface is aligned with the inclined groove surface of one of the grooves of the nut to stably turn the nut.

4 Claims, 7 Drawing Sheets

HOOK SPANNER

BACKGROUND OF THE INVENTION

1. Field of the Invention

The present invention relates to a spanner, especially to a hook spanner that can stably turn an object.

2. Description of the Prior Art

A spanner is a common tool to turn bolts, nuts, or other objects that cannot be easily turned by hand. There are various types of spanners with different structures and functions for turning corresponding objects. One of the common spanners is a hook spanner. The hook spanner is adapted to turn a nut mounted on a machine. The nut mentioned above substantially has multiple flat grooves arranged around an external surface of the nut. Each flat groove has a groove base flat surface. Two kinds of conventional hook spanners 80 are respectively shown in FIGS. 5 and 7. The conventional hook spanner 80 substantially has a hook protrusion 81 having an abutting end surface 811. The abutting end surface 811 of the conventional hook spanner 80 in FIG. 5 is a vertical flat surface 811A. The abutting end surface 811 of the conventional hook spanner 80 in FIG. 7 is a vertical arced convex surface 811B. The hook protrusion 81 of the conventional hook spanner 80 is engaged with one of the flat grooves of the nut, and the abutting end surface 811 abuts against the groove base flat surface of the corresponding flat groove. So the conventional hook spanner 80 can more easily turn the nut than other types of the spanners.

With reference to FIG. 6, a conventional nut 90 fastened on a cutter holder, which is mounted on a tool machine, to fix a cutter in the cutter holder has multiple grooves arranged around an external surface of the conventional nut 90. Each groove has an inclined groove surface 91 extending obliquely and inwardly from a peripheral surface of the conventional nut 90. The abutting end surface 811 of the hook protrusion 81 of the conventional hook spanner 80 is a vertical flat surface 811A as shown in FIG. 5 and is perpendicular to a longitudinal direction of the conventional hook spanner 80. When the conventional hook spanner 80 is used to turn the conventional nut 90, as shown in FIG. 6, the abutting end surface 811 being a vertical flat surface 811A cannot extend along the inclined groove surface 91 of the groove of the conventional nut 90 and contacts the inclined groove surface 91 of the groove of the conventional nut 90 in linear contact.

When using the conventional hook spanner 80 as shown in FIG. 7 that has the abutting end surface 811 being a vertical arced convex surface 811B, the abutting end surface 811 cannot extend along the inclined groove surface 91 of the groove of the conventional nut 90, either. Accordingly, in use, the abutting end surfaces 811 can only contact the inclined groove surfaces 91 of the conventional nut 90 in linear contact, such that the conventional hook spanners 80 cannot stably turn the conventional nuts 90 and are easily disengaged from the conventional nuts 90 during turning of the conventional nuts 90.

To overcome the shortcomings, the present invention provides a hook spanner to mitigate or obviate the aforementioned problems.

SUMMARY OF THE INVENTION

The present invention is to overcome the shortcoming that the abutting end surface 811 of each of the conventional hook spanners 80 cannot extend along the inclined groove surface 91 and only contacts the inclined groove surface 91 of the conventional nut 90 in linear contact during the turning of the conventional nut 90, such that the conventional hook spanner 80 cannot stably turn the conventional nut 90. The main objective of the present invention is to provide a hook spanner that can stably turn a nut.

The hook spanner in accordance with the present invention comprises a spanner body having two opposite side surfaces, a handle segment, and a hooking segment formed on an end of the handle segment. The hooking segment has a hook protrusion located away from the handle segment and having an abutting end surface being an inclined surface extending obliquely from one of the two opposite side surfaces to the other one of the two opposite side surfaces of the spanner body.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
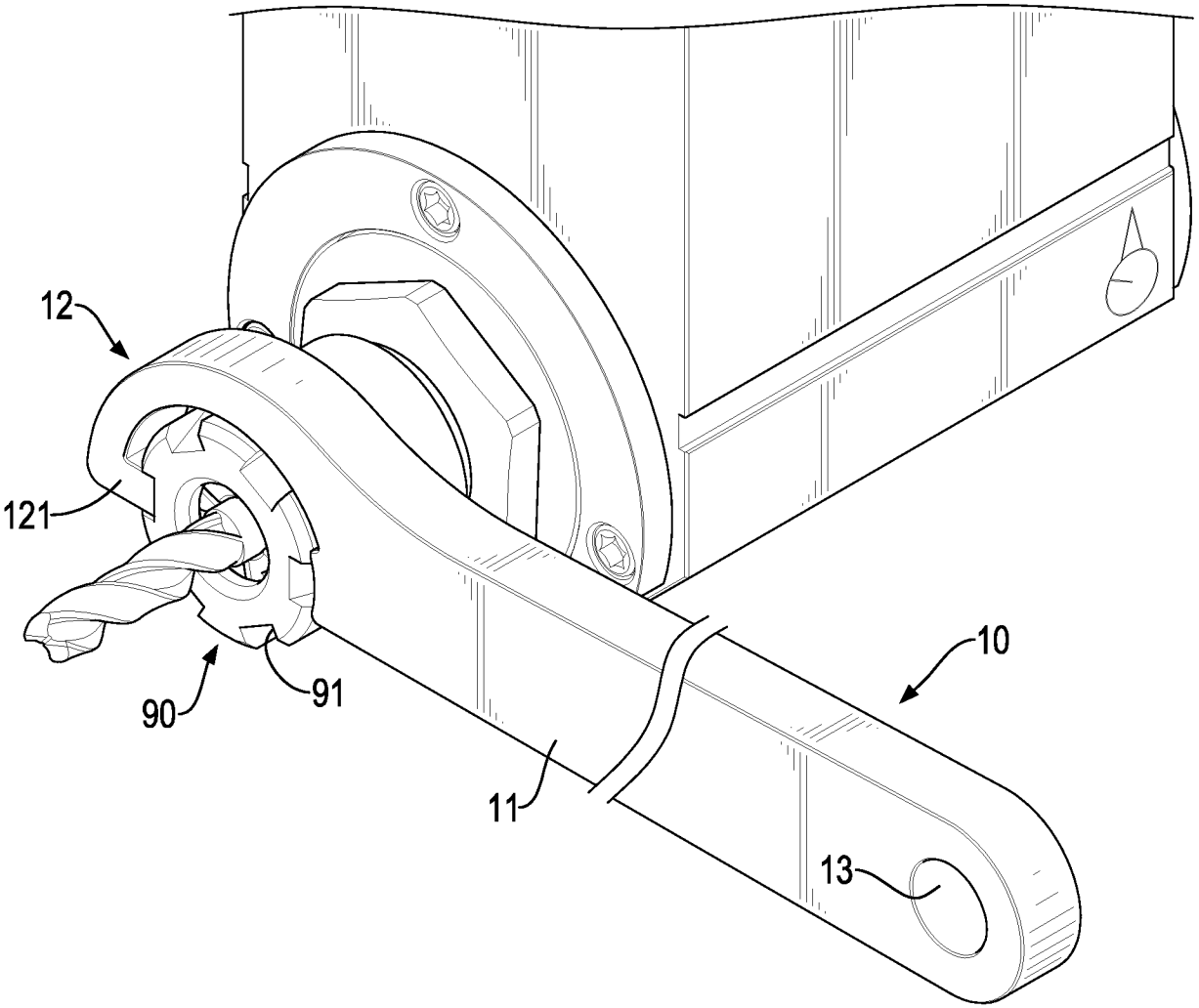
FIG. 1 is an operational perspective view of a hook spanner in accordance with the present invention.
Figure 2:
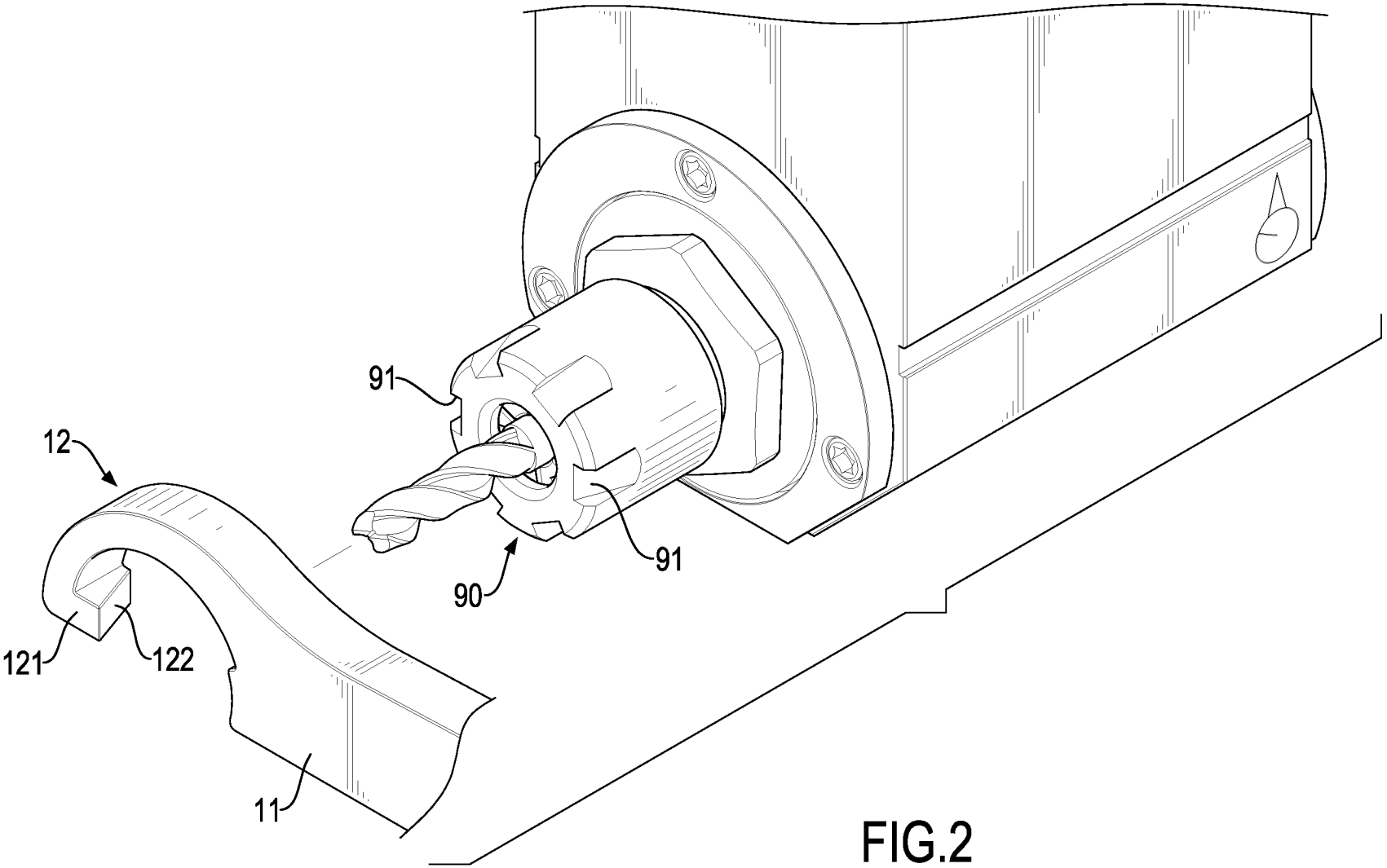
FIG. 2 is an enlarged operational perspective view of the hook spanner in FIG. 1.
Figure 3:
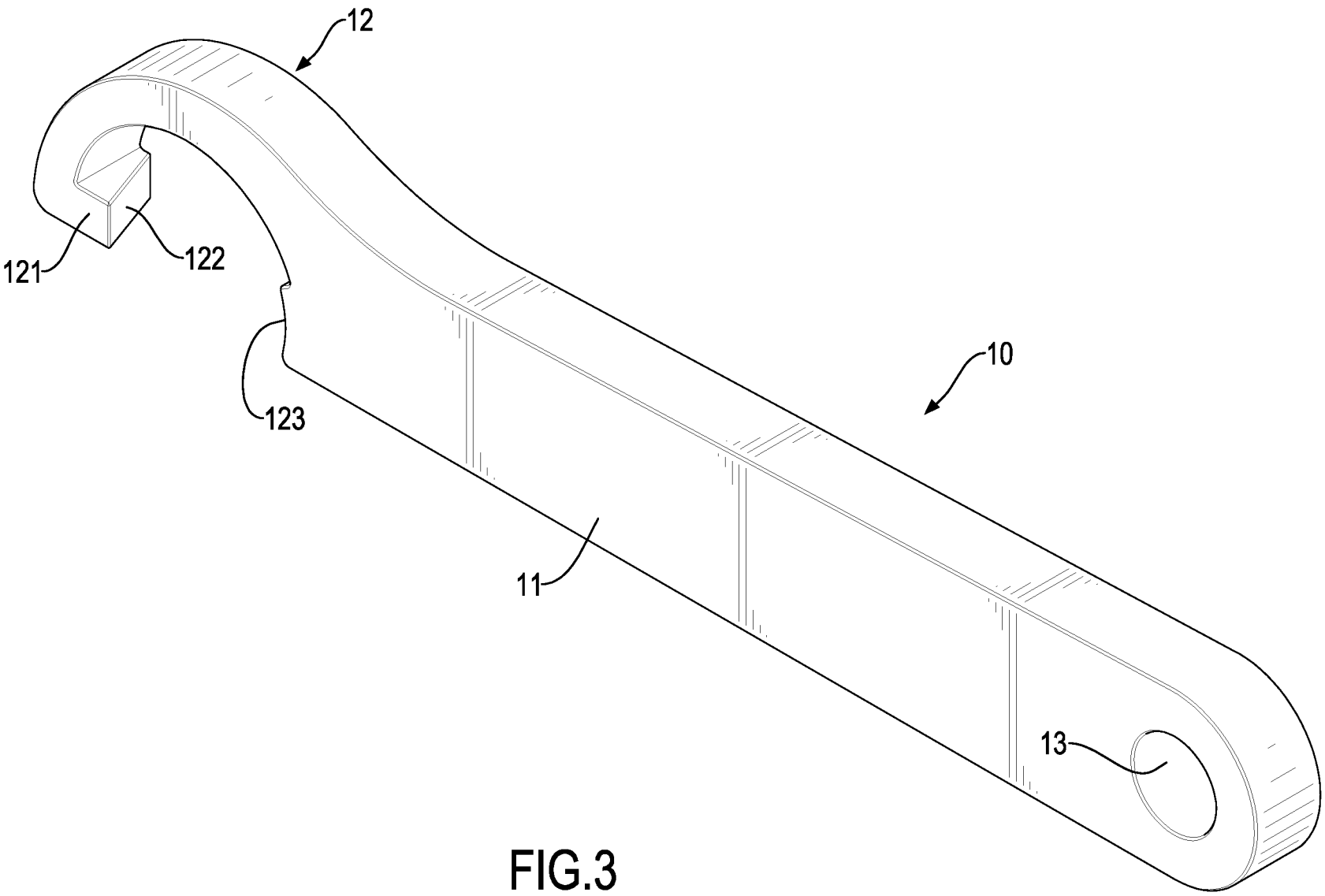
FIG. 3 is a perspective view of the hook spanner in FIG. 1.

With reference to FIGS. 1 to 3, a hook spanner in accordance with the present invention comprises a spanner body 10. The spanner body 10 has two opposite side surfaces, a handle segment 11, a hooking segment 12, and a hanging hole 13. The handle segment 11 is held by a hand of a user.

With reference to FIG. 3, the hooking segment 12 is formed on an end of the handle segment 11 and has a hook protrusion 121 located away from the handle segment 11. The hook protrusion 121 has an abutting end surface 122 being an inclined surface. The hook protrusion 121 extends obliquely from one of the two opposite side surfaces to the other one of the two opposite side surfaces of the spanner body 10. The hooking segment 12 has a concave surface 123 near the handle segment 11, facing the hook protrusion 121, and recessed toward the handle segment 11 for abutting an external peripheral surface of a nut 90.

With reference to FIG. 3, the hanging hole 13 is formed in the handle segment 11, is located away from the hooking segment 12, and is formed through the two opposite side surfaces of the spanner body 10 for hanging conveniently.

Figure 4:
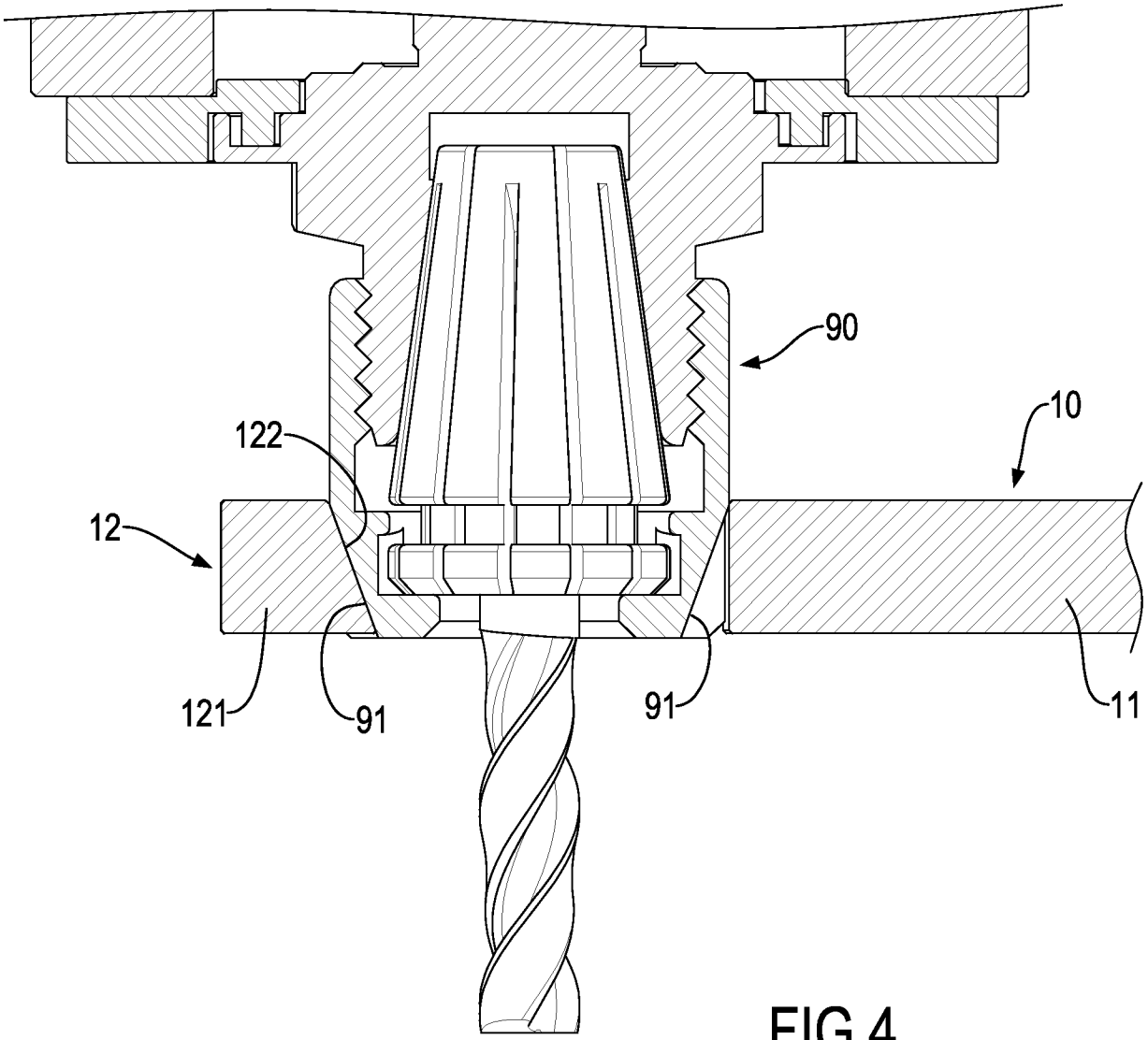
FIG. 4 is an operational side view in partial section of the hook spanner in FIG. 1.
Figure 5:
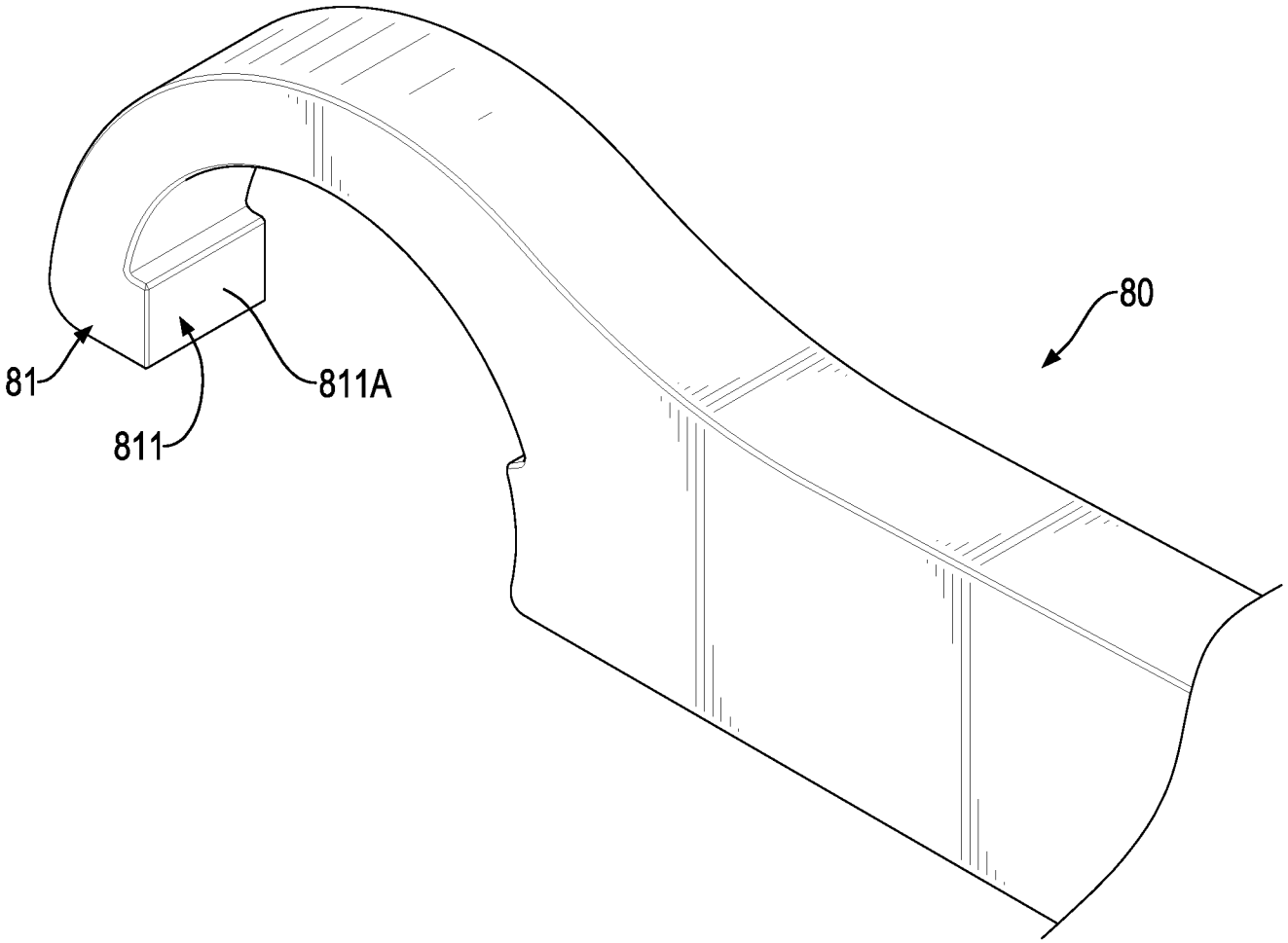
FIG.5 PRIOR ART
FIG. 5 is an enlarged perspective view of a hook spanner in accordance with the prior art.
Figure 6:
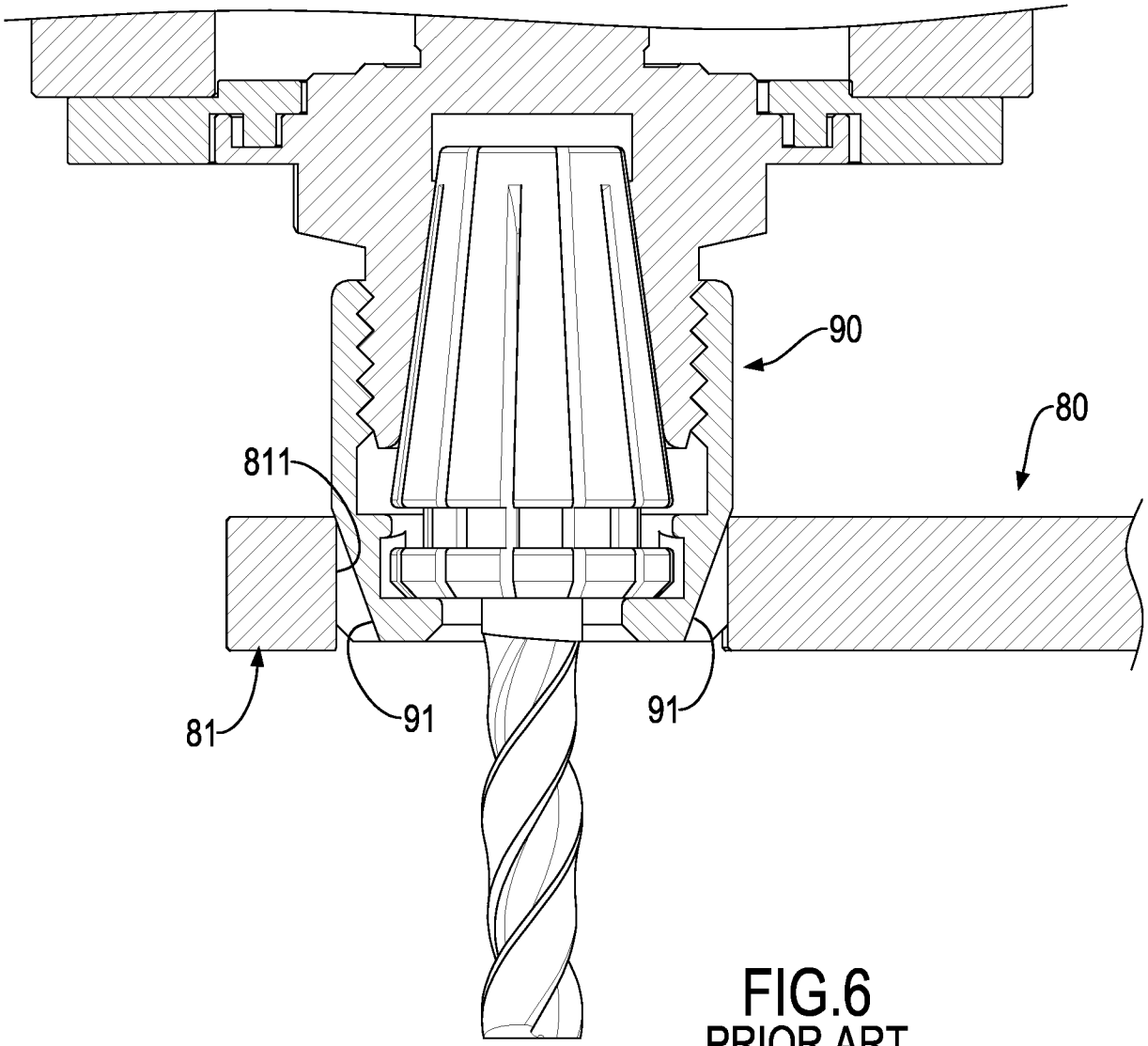
FIG.6 PRIOR ART
FIG. 6 is an operational side view in partial section of the hook spanner in FIG. 5.
Figure 7:
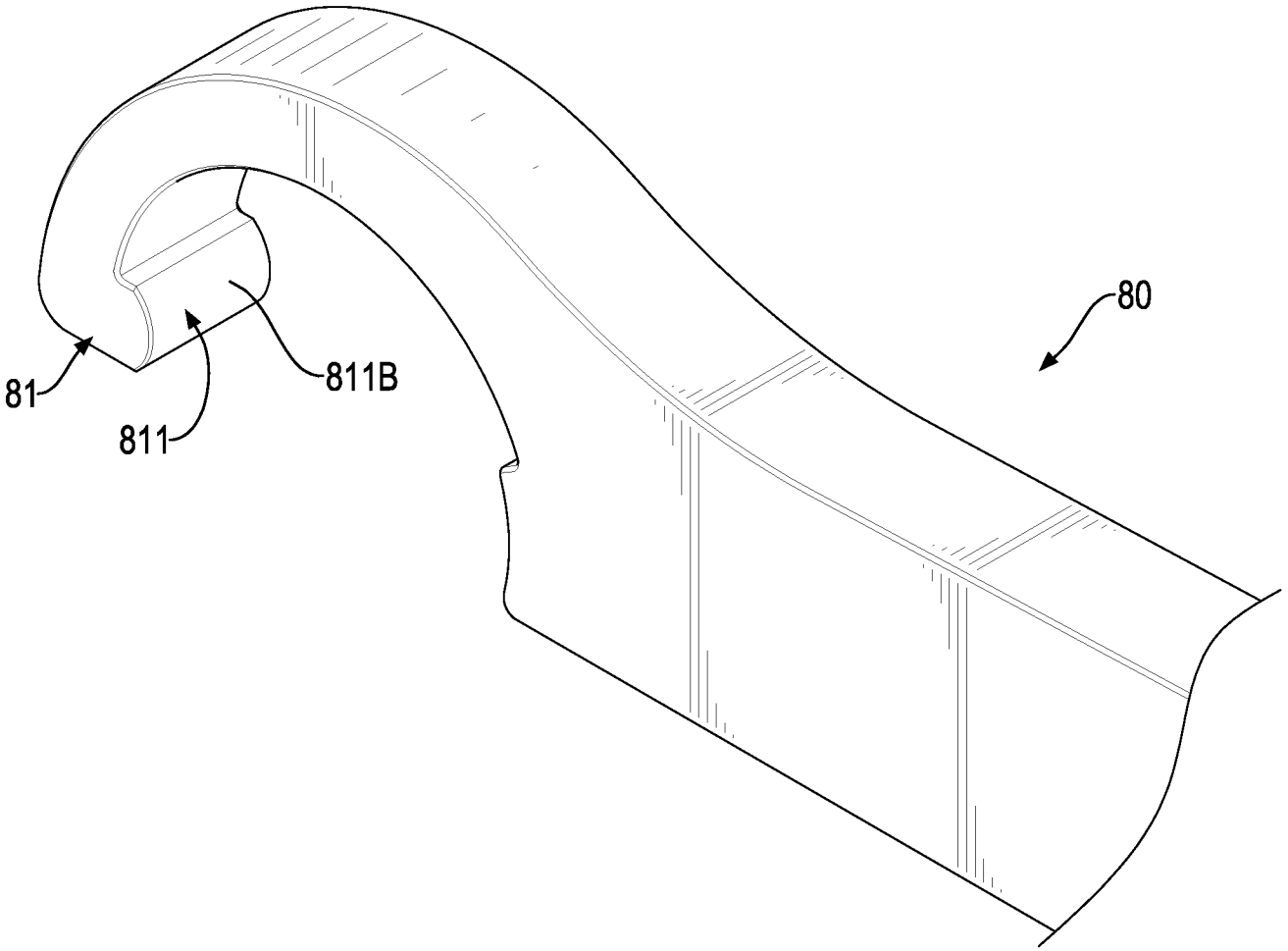
FIG.7 PRIOR ART
FIG. 7 is an enlarged perspective view of another hook spanner in accordance with the prior art.

With reference to FIGS. 1, 2, and 4, the hook spanner in accordance with the present invention is adapted to turn the nut 90 having multiple grooves arranged around the external peripheral surface of the nut 90. Each groove has an inclined groove surface 91 extending obliquely and inwardly from the external peripheral surface of the nut 90. When the hook spanner in accordance with the present invention to turn the nut 90 is in use, the hook protrusion 121 is engaged with one of the grooves of the nut 90, and the abutting end surface 122 is aligned with the inclined groove surface 91 and contacts the inclined groove surface 91 in surface contact, and the concave surface 123 abuts against the external peripheral surface of the nut 90. The hook protrusion 121 can be stably engaged with one of the grooves of the nut 90. Stability and transmission efficiency to turn the nut 90 can be enhanced. Accordingly, the hook spanner in accordance with the present invention that can stably turn the nut 90 can be provided.

In this embodiment, an inclined angle of the abutting end surface 122 corresponds to an inclined angle of the inclined groove surface 91 of each of the grooves of the nut 90. That is, the inclined groove surface 91 of each of the grooves of the nut 90 may be at various inclined angles, and the abutting end surface 122 of the hook spanner corresponds in inclined angle to the inclined groove surface 91 of the corresponding one of the nuts 90. Therefore, the inclined angle of the abutting end surface 122 is not limited to a specific angle.

In addition, the hooking segment 12 and the handle segment 11 can be formed as one single piece, such as this embodiment, or the hooking segment 12 can be connected with the handle segment 11 via hinge connection or movable connection. The spanner body 10 may be an adjustable hook spanner, which is not limited by this embodiment. The spanner body 10 which has an abutting end surface 122 extending obliquely from one of the two opposite side surfaces to the other one of the two opposite side surfaces is within the scope of the claimed invention.

With such arrangement, the hook spanner in accordance with the present invention has advantages as follows.

Because the hook protrusion 121 has an abutting end surface 122 extending obliquely from one of the two opposite side surfaces to the other one of the two opposite side surfaces of the spanner body 10, the abutting end surface 122 is aligned with the inclined groove surface 91 of one of the grooves of the nut 90 and can contact the inclined groove surface 91 in surface contact. So the hook protrusion 121 is stably engaged with one of the grooves of the nut 90. The hook spanner in accordance with the present invention is not easily disengaged from the nut 90 during the turning of the nut 90. Stability and transmission efficiency of the hook spanner to turn the nut 90 can be enhanced.

What is claimed is:

1. A hook spanner comprising:

a spanner body having
- two opposite side surfaces;
- a handle segment; and
- a hooking segment formed on an end of the handle segment and having
  - a hook protrusion located away from the handle segment and having an abutting end surface being an inclined surface extending obliquely from one of the two opposite side surfaces to the other one of the two opposite side surfaces of the spanner body.

2. The hook spanner as claimed in claim 1, wherein the hooking segment has a concave surface located near the handle segment, facing the hook protrusion, and recessed toward the handle segment.

3. The hook spanner as claimed in claim 1, wherein the spanner body has a hanging hole formed in the handle segment, located away from the hooking segment, and formed through the two opposite side surfaces of the spanner body.

4. The hook spanner as claimed in claim 2, wherein the spanner body has a hanging hole formed in the handle segment, located away from the hooking segment, and formed through the two opposite side surfaces of the spanner body.

* * * * *